US005701624A

United States Patent [19]

Shin et al.

[11] Patent Number: 5,701,624

[45] Date of Patent: Dec. 30, 1997

[54] METHOD OF OPERATING A CLOTHES WASHER IN COLD WEATHER

[75] Inventors: Hyun-Doo Shin, Seongnam; Sung-O Jo, Seoul; Eon-Ju Nahm, Anyang, all of Rep. of Korea

[73] Assignee: Samsung Electronics Co., Ltd., Suwon, Rep. of Korea

[21] Appl. No.: 696,502

[22] Filed: Aug. 14, 1996

[30] Foreign Application Priority Data

Oct. 7, 1995 [KR] Rep. of Korea ..... 95-34441

[51] Int. Cl.[6] ..... D06F 33/02

[52] U.S. Cl. ..... 8/159; 68/12.01; 68/12.04

[58] Field of Search ..... 8/158, 159; 68/12.01, 68/12.02, 12.04

[56] References Cited

U.S. PATENT DOCUMENTS 4,862,710 9/1989 Torita et al. ..... 68/12.01

5,606,877 3/1997 Hashimoto ..... 68/12.04

*Primary Examiner*—Philip R. Coe

*Attorney, Agent, or Firm*—Burns, Doane, Swecker & Mathis, L.L.P.

[57] ABSTRACT

A clothes washing machine has a controller which can be set for a winter operation mode, i.e., when the wash water is relatively cold. In the winter operation mode, the weight of laundry articles in the wash tub is determined. If the weight is less a reference weight, the laundry articles are washed for a first time period. If the weight is more than the reference weight, the laundry articles are washed for a longer time period.

2 Claims, 4 Drawing Sheets

METHOD OF OPERATING A CLOTHES WASHER IN COLD WEATHER

BACKGROUND OF THE INVENTION

1. Field of the Invention

The present invention relates to a control method of a washing machine which is capable of rinsing and washing efficiently when the washing water is cold, for example, in winter.

2. Description of the Prior Art

There has been proposed a washing machine in Japanese Patent Laid-Open Publication NO.5-161776. Referring to FIG. 4 showing the washing machine disclosed in the above publication, the washing operation of the laundry articles is started at step S31.

Thereafter, at step S32, it is determined whether or not washing water that was supplied to a tub from a faucet is splashing above a predetermined water level, i.e. is being excessively agitated.

When the washing water overflows over the predetermined water level (namely, if YES), the procedure proceeds to step S35.

At step S35, a water current being produced by a; pulsator is changed under a control of a control means.

That is, the washing operation is executed by the changed water current at step S35.

Meanwhile, when the washing water is determined at step S32 as not passing above the predetermined water level (namely, if NO), the procedure proceeds to step S33.

At step S33, it is determined whether or not there has elapsed a predetermined washing time previously stored in the control means.

As a result, when the washing time is determined at step S33 as having elapsed (namely, if YES), the procedure proceeds to step S34.

Therefore, the washing operation is no longer executed.

Meanwhile, when the washing time is determined at step S33 as not having elapsed, (namely, if NO), the procedure returns to step S32 and repeatedly executed the procedure from step S32.

However, the above washing machine has a problem that the washing efficiency is low when the washing operation, because the water is colder.

SUMMARY OF THE INVENTION

It is, therefore, an object of the present invention to provide a control method of a washing machine in which the aforementioned problems can be overcome and which is capable of a rinsing and washing efficiency when a temperature of the washing water is low.

To accomplish the above object, a control method of a washing machine in accordance with an embodiment of the present invention comprises the steps of determining whether or not a washing course for winter is selected, determining a weight of laundry articles when the washing course for winter is selected, washing the laundry articles for a first predetermined time previously stored in a control means by a water current corresponding to the washing course for winter when the weight of the laundry articles is lower than a predetermined weight previously stored in the control means and washing the laundry articles for a longer time period when the weight is greater than a predetermined weight.

BRIEF DESCRIPTION OF THE DRAWINGS

Other objects and aspects of the invention will become apparent from the following description of embodiment with reference to the accompanying drawings in which.

DESCRIPTION OF THE PREFERRED EMBODIMENT

Figure 1:
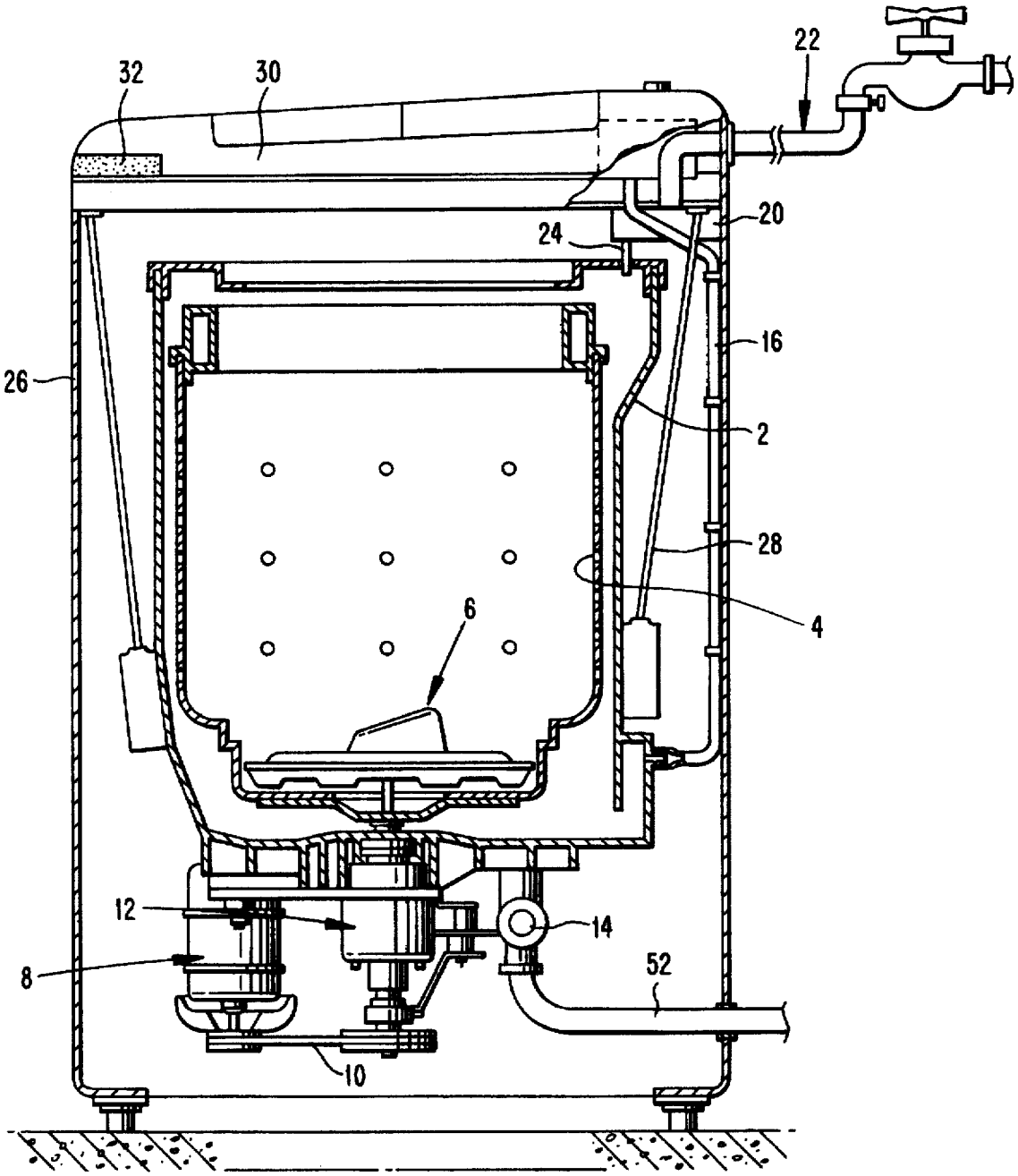
FIG. 1 PRIOR ART
FIG. 1 is a cross sectional view of a prior art washing machine capable of carrying out the present invention.

With reference to FIG. 1, there is shown in a cross sectional view of a washer capable of carrying out the present invention.

As shown in FIG. 1, a washing machine comprises a main body 1 including a perforated washing and drying basket 4, which basket 4 is mounted on a clutch case such that it is rotated in a tub 2. The tub 2 is mounted to the main body 1 by an arrangement of suspension rods 28. The tub 2 and the basket 4 define a clothes container assembly. A pulsator or agitator 6 is connected to an output shaft 10 of a clutch device of the clutch case on the bottom of the washing and drying basket 4 and is rotated in both (i.e., is oscillated) by a drive motor 8 mounted on the bottom surface of the tub 2, thus to form a violent water current and to wash the laundry articles in the washing and drying basket 4.

The washing machine further includes a water discharge valve 14, which is provided at a predetermined section of a water discharge hose 52, for discharging washing water from the basket 4.

The tub 2 is provided at the lower position thereof with a washing water detecting hose 16, and is provided at the upper position thereof with a container 20 adapted to be filled with a powder detergent which flows into the tub 2 through a water supply pipe 24 together with washing water from a service pipe 22.

The main body 26 is coupled with a door 30 to open or close the tub 2.

A control box 32 is provided in the front of the door 30.

Figure 2:
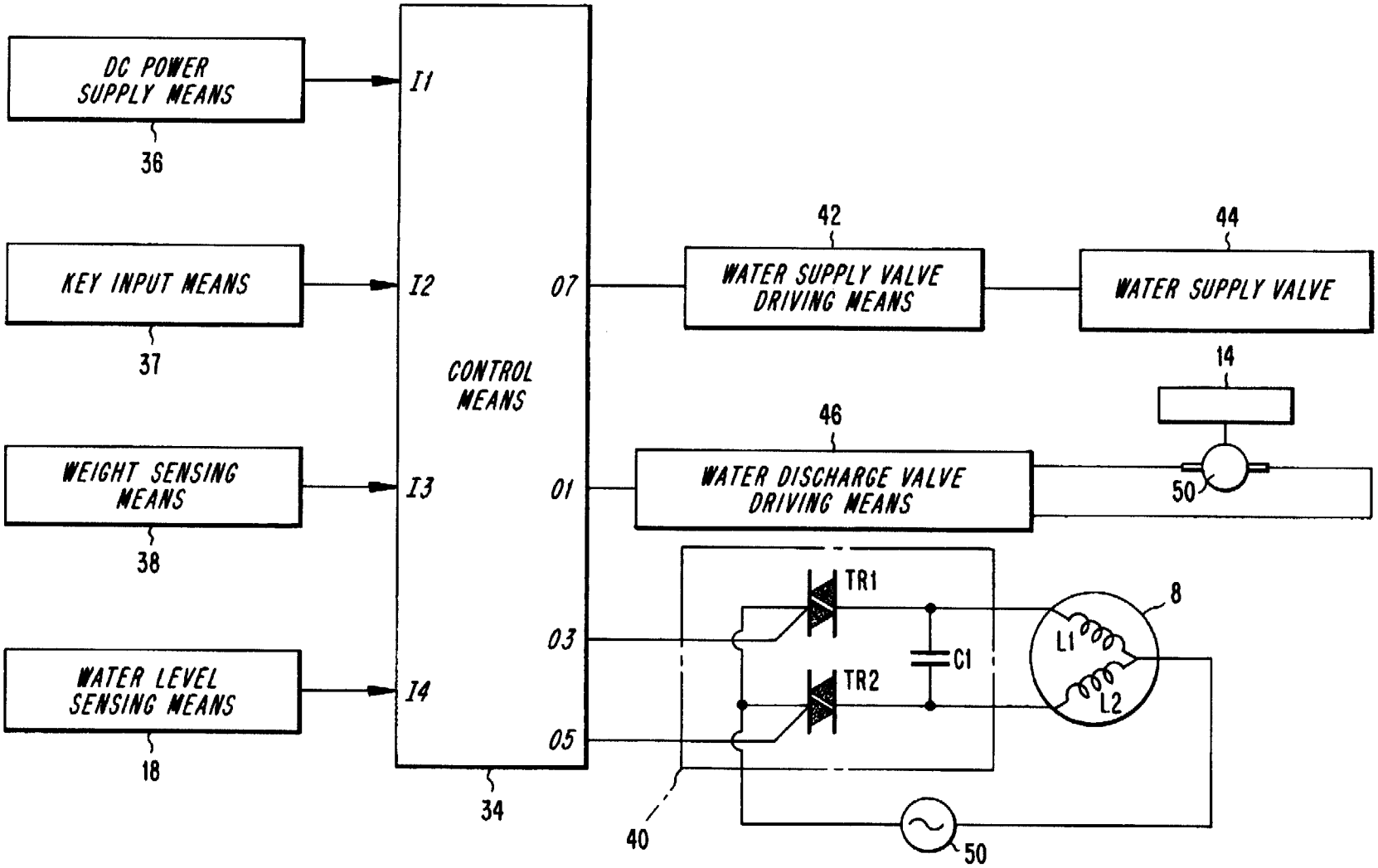
FIG. 2 is a block diagram of the washing machine of the present invention.

FIG. 2 is a block diagram of a control device for the washing machine of the present invention.

As shown in FIG. 2, the control device of the washing machine comprises control means 34 for controlling an overall operation of the washing machine, and for storing a program to control the washing operation therein.

The control means 34 is a microcomputer.

DC power supply means 36 converts a commercial AC power source, input at an AC power input stage (not shown), into a DC voltage with a voltage level required to drive the washing machine.

The control device also includes key input means 37 to establish data necessary to operate the washing machine.

The control device also includes weight sensing means 38 for sensing the weight of the laundry articles in the basket 4 and for outputting the sensed weight as a signal to the control means 34.

The DC power supply means 36, the key input means 37 and the weight sensing means 38 are coupled to the control means 34.

The weight sensing means 38 is a piezoelectric sensor which is attached to a power transmission 12.

Water level sensing means 18 is also coupled to the control means 34.

The water level sensing means 18 senses the amount of water in the tub 2, namely the water level in the tub 2.

Water level data from the water level sensing means 18 is sent to the control means 34 to control the supply of water to the tub 2.

Motor driving means 40 is also coupled to the control means 34.

The motor driving means 40 is served to drive a motor 8.

The motor driving means 40 comprises a capacitor C1 for generating a phase difference of current flowing through coils L1 and L2 which are provided in the motor 8, and switching means TR1 and TR2 for changing the direction of voltage being supplied to the capacitor C1 so that the rotational direction of the motor 8 is changed.

The control device also includes water supply valve driving means 42 to control a water supply valve 44.

The water supply valve driving means 42 receives a control signal which is generated from the control means 34 in accordance with the water level of the tub 2 sensed by the water level sensing means 18.

In accordance with the control signal from the control means 34 the water supply valve driving means 42 controls the water supply valve 44, thereby opening or closing the water supply valve 44.

The control device also includes water discharge valve driving means 46 to control a water discharge valve 14.

The water discharge valve driving means 46 receives a control signal which is generated from the control means 34 in accordance with the finish of washing operation.

In accordance with the control signal from the control means 34 the water discharge valve driving means 46 drives a water discharge motor 50 to open or to close the water discharge valve 14.

The operation of the washing machine having the above-mentioned construction will now be described in conjunction with FIG. 3.

Figure 3:
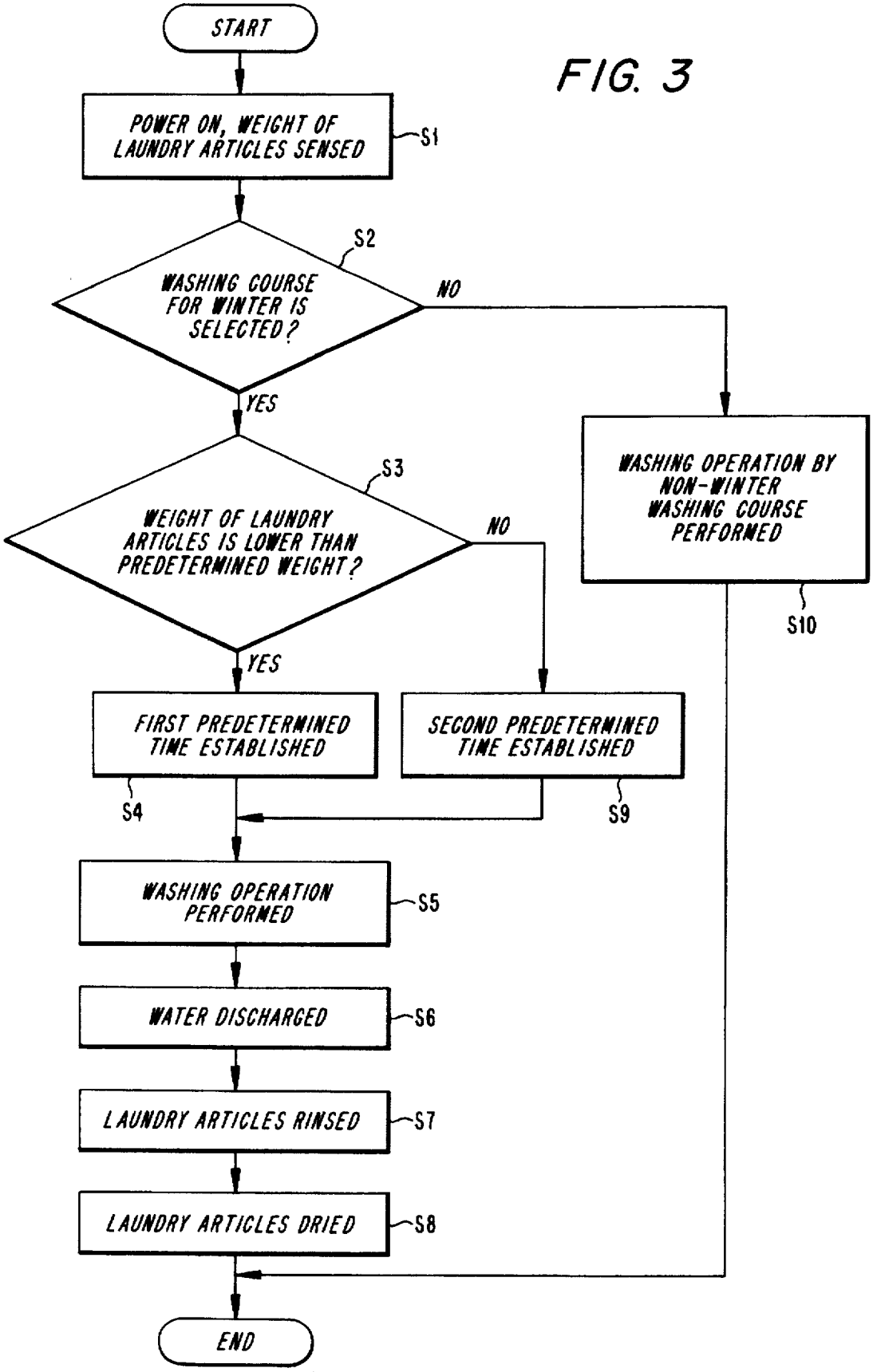
FIG. 3 is a flow chart exhibiting the operating procedure of the washing machine according to the present invention.
Figure 4:
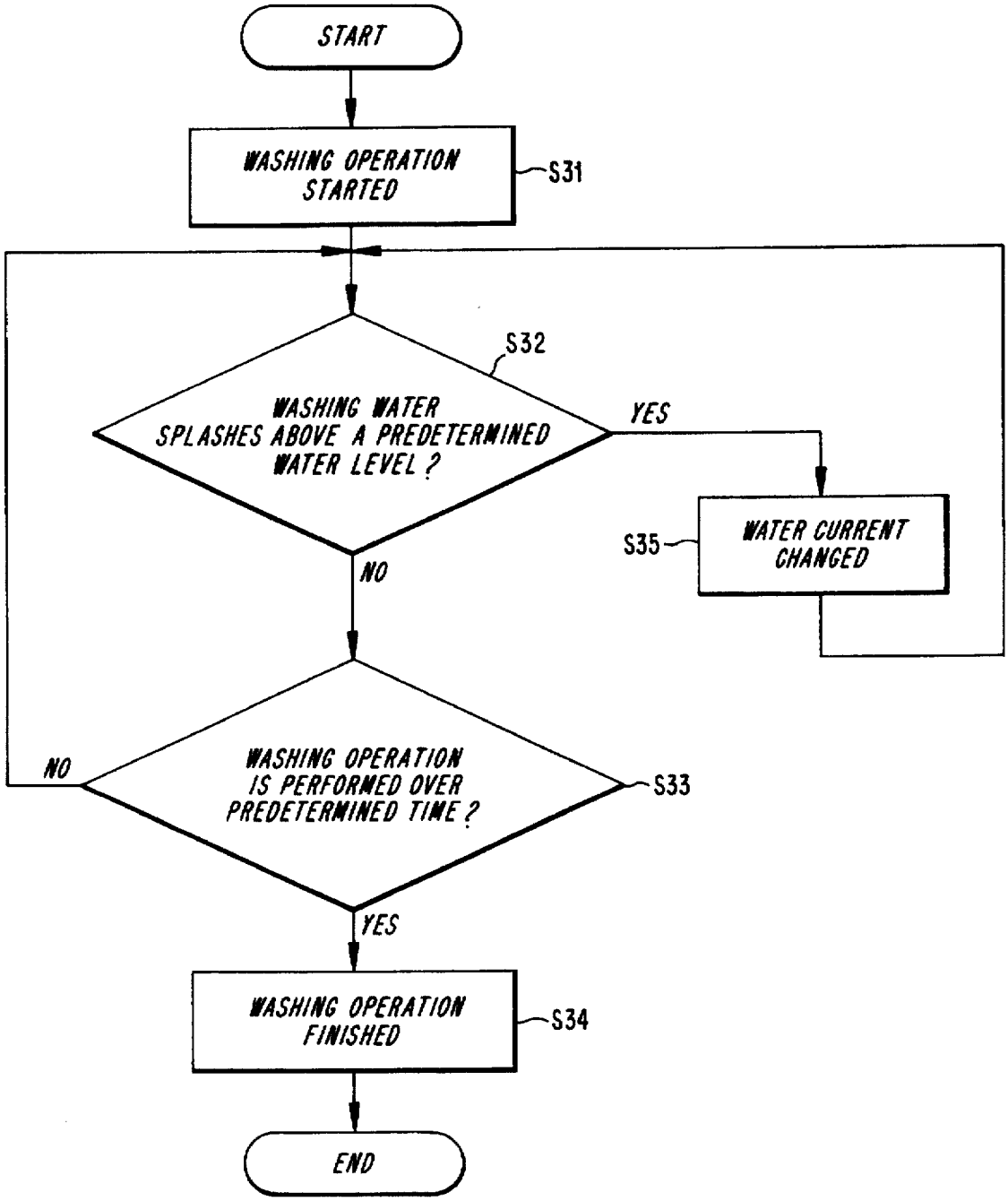
FIG. 4 PRIOR ART
FIG. 4 is a flow chart exhibiting the operating procedure of the washing machine according to the prior art.

FIG. 3 is a flow chart for exhibiting the procedure of controlling the washing machine according to the present invention.

The DC power supply means 36 converts a source voltage received from a commercial AC power source at its AC power input stage (not shown) into a DC voltage with a voltage level required to drive the washing machine.

The DC voltage from the DC power supply means 36 is then applied to the control means 34 as well as various driving circuits at step S1.

Upon receiving the DC voltage from the DC power supply means 36, the control means 34 intializes the washing machine.

Subsequently, an operating switch (not shown) of the key input means 37 is turned on, and the weight sensing means 38 senses the weight of the laundry articles put in the basket 4.

Weight sensing data from the weight sensing means 37 is sent to the control means 34 through an input port I3.

At step S2 user presses the key input means 37 to establish the user's desired washing course in the control means.

The washing course, which is selected by the user, is stored in the control means 34.

Thereafter, it is determined at step S2 whether or not the washing course for winter is selected by Key input means 37.

As a result, when the washing course for winter is determined at step S2 as being selected (namely, if YES), the procedure proceeds to step S3.

At step S3, it is determined whether or not the weight of the laundry articles in the basket 4 sensed by the weight sensing means 38 is lower than a predetermined weight, for example, 8 kg, previously stored in the control means 34.

When the weight of the laundry articles in the basket 4 is determined at step S3 as being lower than the predetermined weight (namely, if YES), the procedure proceeds to step S4.

At step S4, the control means 34 determines that the washing operation of the laundry articles in the basket 4 must be performed for a first predetermined time previously stored in the control means 34. The first predetermined time is 15 minutes.

Subsequently, at step S5, the control means 34 applies a control signal to the water supply valve driving means 42 through an output port 07 to open the water supply valve 44.

In accordance with the control signal from the control means 34, the water supply valve driving means 42 supplies the source voltage to the water supply valve 44, thereby opening the water supply valve 44.

When the water supply valve 44 is opened, fresh water, such as tap water, from the service pipe 22 is supplied to the water supply pipe 24 through the container 20. Therefore, the tap water is supplied into the tub 2 together with detergent in the container 20.

Which supplying the water into the tub 2, the water level sensing means 18 senses the amount of water stored in the tub 2, namely the water level in the tub 2.

Water level data from the water level sensing means 18 is sent to the control means 34 through an input port I4.

It is then determined whether or not the water level of the tub 2 sensed by the water level sensing means 18 is higher than a predetermined water level corresponding to the weight of the laundry articles in the basket 4.

When the water level of the tub 2 is higher than the predetermined water level, the control means 34 applies a control signal to the water supply valve driving means 42 through an output port 07 to close the water supply valve 44.

In accordance with the control signal from the control means 34, the water supply valve driving means 42 cuts off the source voltage being applied to the water supply valve 44, thereby closing the water supply valve 44.

Therefore, the water is no longer supplied to the tub 2.

Subsequently, at step S5, the control means 34 applies, a control signal corresponding to the washing course for winter, to the motor driving means 40 to drive the motor 8 through output ports 03 and 05.

In accordance with the control signal from the control means 34, the motor driving means 40 supplies the source voltage to the motor 8, thereby driving the motor 8 in the following sequence.

rotating left for 1.5 seconds→stop for 1.1 seconds→rotating left for 1.7 seconds→stop for 1.1. seconds→rotating right for 1.5 seconds→stop for 1.1 seconds→rotating right for 1.9 seconds→stop for 1.1 seconds.

According to rotating the motor 8 as the foregoing description, the pulsator 6 is also rotated in the same direction of the motor 8 by the rotating force from the motor 8 through the power transmission 12.

Therefore, a certain water current is produced corresponding to the washing course for winter to wash the laundry articles in the basket 4.

After washing the laundry articles in the basket 4 for the predetermined time, the control means 34 applies, to the water discharge valve driving means 46 through an output port 01, a control signal for opening the water discharge valve 14 to discharge the water in the tub 2 at step S6.

Therefore, the water discharge valve driving means 46 supplies the source voltage to the water discharge valve 14 under the control of the control means 34, thereby opening the water discharge valve 14.

When the water discharge valve 14 is opened, the wash water in the tub 2 is discharged outside.

Subsequently, at step S7, the control means 34 applies a control signal to the water supply valve driving means 42 to open the water supply valve 44.

In accordance with the control signal from the control means 34, the water supply valve driving means 42 supplies the source voltage to the water supply valve 44, thereby opening the water supply valve 44.

When the water supply valve 44 is opened, fresh water, such as tap water, from the service pipe 22 is supplied to the tub 2 thereby rinsing the laundry articles in the basket 4.

After rinsing the laundry articles in the basket 4, the water in the tub 2 is discharged by opening the water discharge valve 14 in the same manner as above-described.

At step S8, the basket 4 and the pulsator 6 are rotated in the same direction to spin dry the laundry articles in the basket 4 under the control of the control means 34.

Meanwhile, when the weight of the laundry articles in the basket 4 is determined at step S3 as being not lower than the predetermined weight previously stored in the control means 34 (namely, if NO), the procedure proceeds to step S9.

At step S9, the control means 34 determines that the washing operation of the laundry articles in the basket 4 must be performed for a second predetermined time previously stored therein. The second predetermined time is 25 minutes.

Subsequently, at step S5, the control means 34 applies a control signal corresponding to the washing course for winter, to the motor driving means 40 to drive the motor 8.

In accordance with the control signal from the control means 34, the motor driving means 40 supplies the sourse voltage to the motor 8, thereby driving the motor 8 in the foregoing description.

That is, the motor 8 is driven for the second predetermined time to produce the certain water current corresponding to the washing course for winter.

Meanwhile, when the washing course for winter is not selected at step S2 by the user (namely, if NO), the procedure proceeds to step S10.

At step S10, the control means 34 controls the washing machine to perform the washing operation of the laundry articles in the basket 4 by a non-winter washing course.

Having described specific preferred embodiments of the invention with reference to the accompanying drawings, it is to be Understood that the invention is not limited to those precise embodiments, and that various changes and modifications may be effected therein by one skilled in the art without departing from the scope or spirit of the invention as defined in the appended claims.

What is claimed:

1. A method of controlling a washing machine including the steps of:

A) determining whether or not a washing mode for winter is selected;

B) determining a weight of a load of laundry in a wash tub when the washing mode for winter is selected;

C) washing the laundry load for a first predetermined time period when a weight of the laundry load is lower than a predetermined weight; and D) washing the laundry load for a second predetermined time period, longer than the first time period, when a weight of the laundry load is not lower than the predetermined weight.

2. The method according to claim 1 wherein step D comprises rotating an agitator by repeating the following cycle: rotating the agitator about a vertical axis in a first direction, then stopping the agitator; then rotating the agitator again in the first direction, then stopping the agitator; then rotating the agitator in a second direction opposite the first direction, then stopping the agitator; and then rotating the agitator again in the second direction.

* * * * *